US005449147A

United States Patent [19]

Pace et al.

[11] Patent Number: 5,449,147

[45] Date of Patent: Sep. 12, 1995

[54] VALVE SPRING

[75] Inventors: J. Gary Pace, Rochester; Jerry P. Harkey, Bloomfield Hills; James R. Klotz, Mt. Clemens; James P. Savoyard, Fairhaven, all of Mich.

[73] Assignee: Chrysler Corporation, Highland Park, Mich.

[21] Appl. No.: 362,383

[22] Filed: Dec. 12, 1994

[51] Int. Cl.[6] ..... F01I 3/10; F16F 1/00

[52] U.S. Cl. ..... 251/337; 123/90.65; 267/158

[58] Field of Search ..... 251/337; 123/90.65; 267/158

[56] References Cited

U.S. PATENT DOCUMENTS 3,097,633 7/1963 Klein ..... 123/90.65
3,482,555 12/1969 Sherbinsky et al. ..... 123/90.65
3,508,528 4/1970 Sherbinsky, III ..... 123/90.65
3,602,205 8/1971 Turkish ..... 123/90.65
4,420,141 12/1983 Goloff ..... 251/337

*Primary Examiner*—A. Michael Chambers
*Attorney, Agent, or Firm*—Kenneth H. MacLean

[57] ABSTRACT

This application concerns a leaf type spring for closing valves in a cylinder head of an internal combustion engine. Specifically, the leaf spring has an edge base which is attached to the cylinder head and a cantilevered unsupported portion which extends therefrom. The unsupported portion is bifurcated to form two arms, each arm engaging a valve in a manner biasing it towards its closed operative position and yieldably permitting the valve to be moved toward its open operative position.

6 Claims, 2 Drawing Sheets

VALVE SPRING

BACKGROUND OF THE INVENTION

1. Field of the Invention

This application discloses a combination leaf spring arrangement to close adjacent intake and exhaust valves of an internal combustion engine. Specifically, the leaf spring has an base or edge which is attached to the engine's cylinder head and an unsupported portion extending therefrom in a cantilevered manner. The unsupported portion is separated into two arm portions, one arm engaging an intake valve and the other arm engaging the exhaust valve. The natural resiliency of the cantilevered arms tend to bias the valves towards closed operative positions.

2. Description of the Related Art

The use of springs to close the typical poppet type engine valve is universal at least for passenger vehicle and light truck engines. The coil spring has found wide spread an long term use for this purpose. A disadvantage of coil springs is their relatively great length which results in a larger (higher) cylinder head than would otherwise be desired.

In the 1950's, "mouse trap" type springs were used by Ferrari to reduce cylinder head size. A mouse trap spring is a wire device with a coil formed at a midportion and with its end portions extending therefrom. One of the ends engaged the cylinder head and the other engaged the valve. Opening movement of the valve caused the coil shaped midportion to be rotated which generated a torsion force to yieldably resist opening of the valve. "Mouse trap" type springs are disclosed in U.S. Pat. Nos.: 3,097,633 to Klein; 3,482,555 to Sherbinsky et al; and 4,420,141 to Goloff.

Currently, some racing type engines have replaced the metal valve spring entirely and substituted a variable chamber filled with a compressible gas such as nitrogen.

Also, there are patents disclosing the use of a leaf spring in internal combustion engines. For example, in FIG. 4 of the U.S. Pat. No. 1,236,643 to Adams et al. a leaf spring is disclosed. The specification describes the leaf spring as being supported at a midpoint with the opposite ends engaging inlet valve j and outlet valve l respectively.

In U.S. Pat. No. 1,277,742 to Mummert, a leaf type spring 27 is mounted at a midpoint by shaft 25 with end portions engaging valves 6 and 7. likewise, in U.S. Pat. No. 1,523,583 to Chilton, a multi-layered or laminated leaf spring 29 is mounted at a midpoint with ends engaging valve ends 25 of valves 22, 23.

In U.S. Pat. No. 4,617,882 to Matsomoto discloses a dual overhead camshaft-type cylinder head in which the intake and exhaust cam shafts are gear driven each by a single idler gear which itself is driven by another idler gear which, in turn, is driven by a gear on the engine crankshaft. A disadvantage of this arrangement is the stacked juxtaposition of all these gears which necessitate a fixed geometry of the driving mechanism as well as the spacing of the intake from the exhaust camshaft.

The U.S. Pat. No. 3,602,205 to Turkish discloses a leaf type spring arrangement for a valve requiring a pair of elongated spring members each with one end clamped to the cylinder head and a free end engaging a valve retainer.

SUMMARY OF THE INVENTION

This application discloses an integral leaf spring for closing an intake valve and an exhaust valve of an internal combustion engine. Specifically, the leaf spring has an edge which is firmly attached to the engine's cylinder head with the remainder of the leaf spring unsupported. The unsupported portion cantilevers from the fixed base portion and can flex upwards and downwards from the plane of the spring. The unsupported portion is bifurcated or separated into two arms portions, one arm engaging the intake valve and the second arm engaging the exhaust valve. The resiliency of the leaf spring yieldably urges the valves towards closed operative positions. Also, one arm is formed with an oblique end portion so as to be in a plane normal to the axis of the valve.

DESCRIPTION OF A PREFERRED EMBODIMENT

Figure 2:
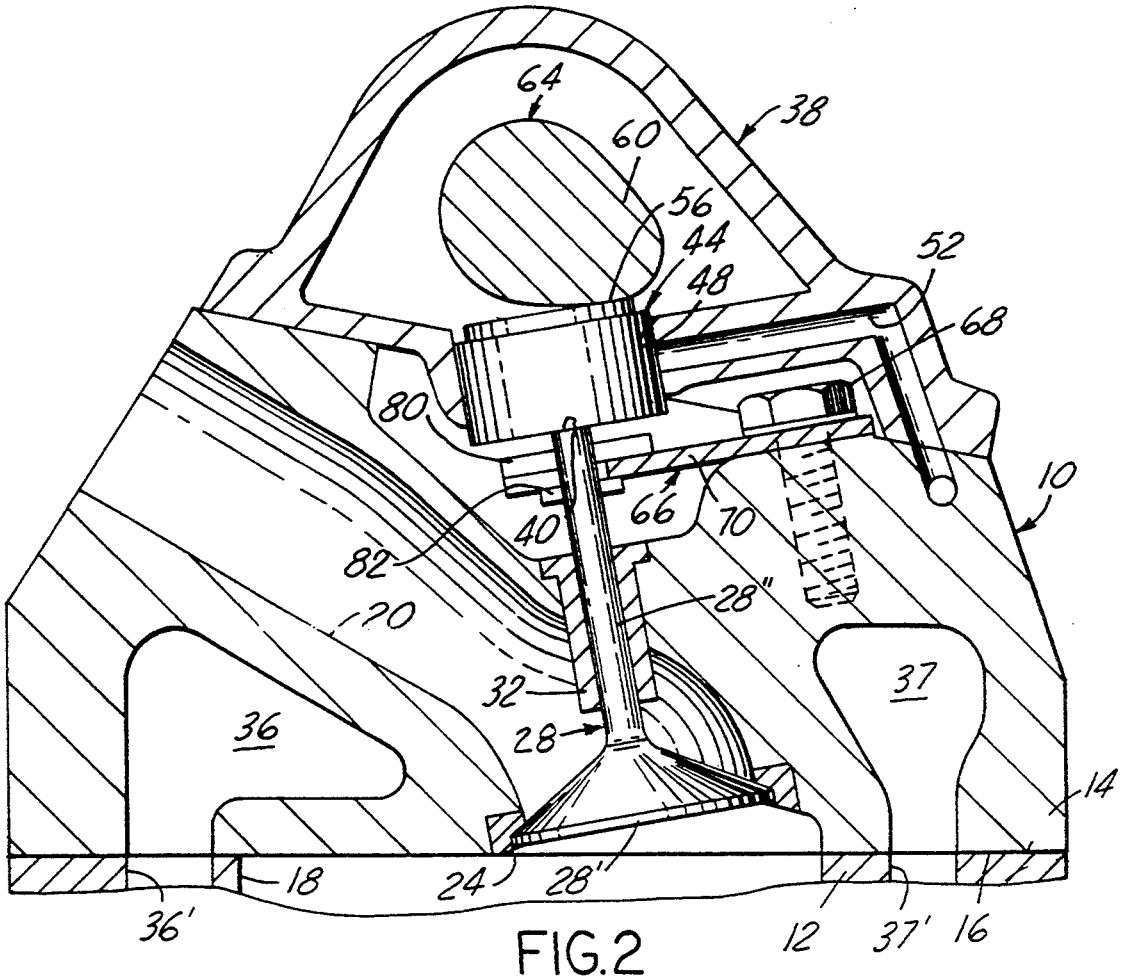
FIG. 2 is an elevational sectioned view of the cylinder head and leaf spring taken along section line 2—2 in FIG. 1 and looking in the direction of the arrows.

In the drawings, a cylinder head 10 for an internal combustion engine is shown. As best shown in FIG. 2, the cylinder head 10 is mounted to an engine block 12. Specifically, a planar upper surface 14 of the engine block 12 supports a planar lower surface 16 of the cylinder head 10. Typically, a thin head gasket (not shown) would be interposed between the engine block and the cylinder head.

Figure 1:
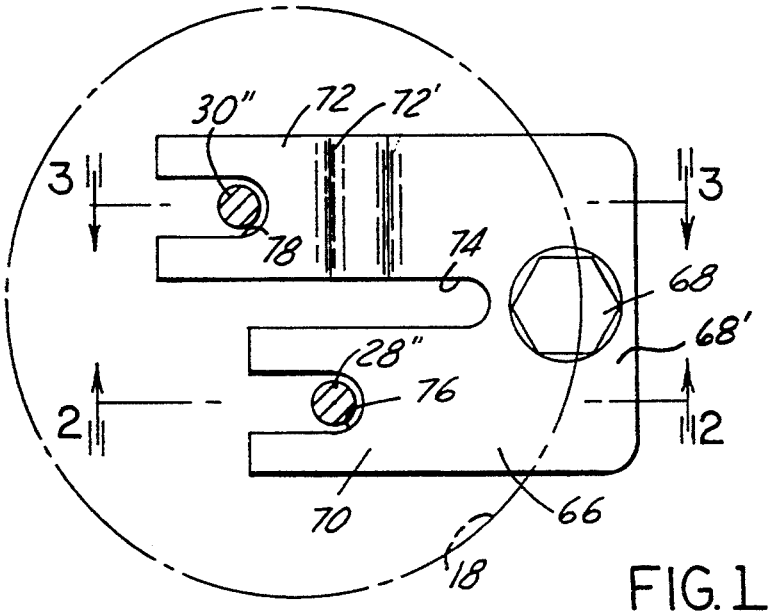
FIG. 1 is a planar top view of the subject combination intake and exhaust valve spring and its relationship to the cylinder, the intake valve, and the exhaust valve.

As seen in FIGS. 1 and 2, the engine block 12 defines a cylinder bore 18 (only one shown). Typically, an engine might have between one and twelve cylinders. Each bore 18 supports a reciprocally moveable piston (not shown) as is well know in the engine art. The space defined by each bore 18 and associated piston is selectively supplied with a quantity of air and fuel through an inlet passage 20 formed in the cylinder head 10 as illustrated in FIG. 2. Likewise, the products of combustion or exhaust is discharged from this space through an exhaust passage 22 illustrated in FIG. 3. The inlet and exhaust passages 20, 22 each support annular valve seats 24, 26 respectively. Flow through the inlet and exhaust passages is controlled by an inlet valve 28 and an exhaust valve 30, respectively. Specifically, the inlet valve 28 has an enlarged head portion 28' adapted to engage the associated valve seat member 24. Likewise, the exhaust valve 30 has an enlarged head portion 30' adapted to engage the associated valve seat member 26 The head portions 28', 30' are integrally connected to elongated stem portions 28'', 30''. The stem portions are supported for axial reciprocation in valve guide members 32, 34, respectively.

Figure 3:
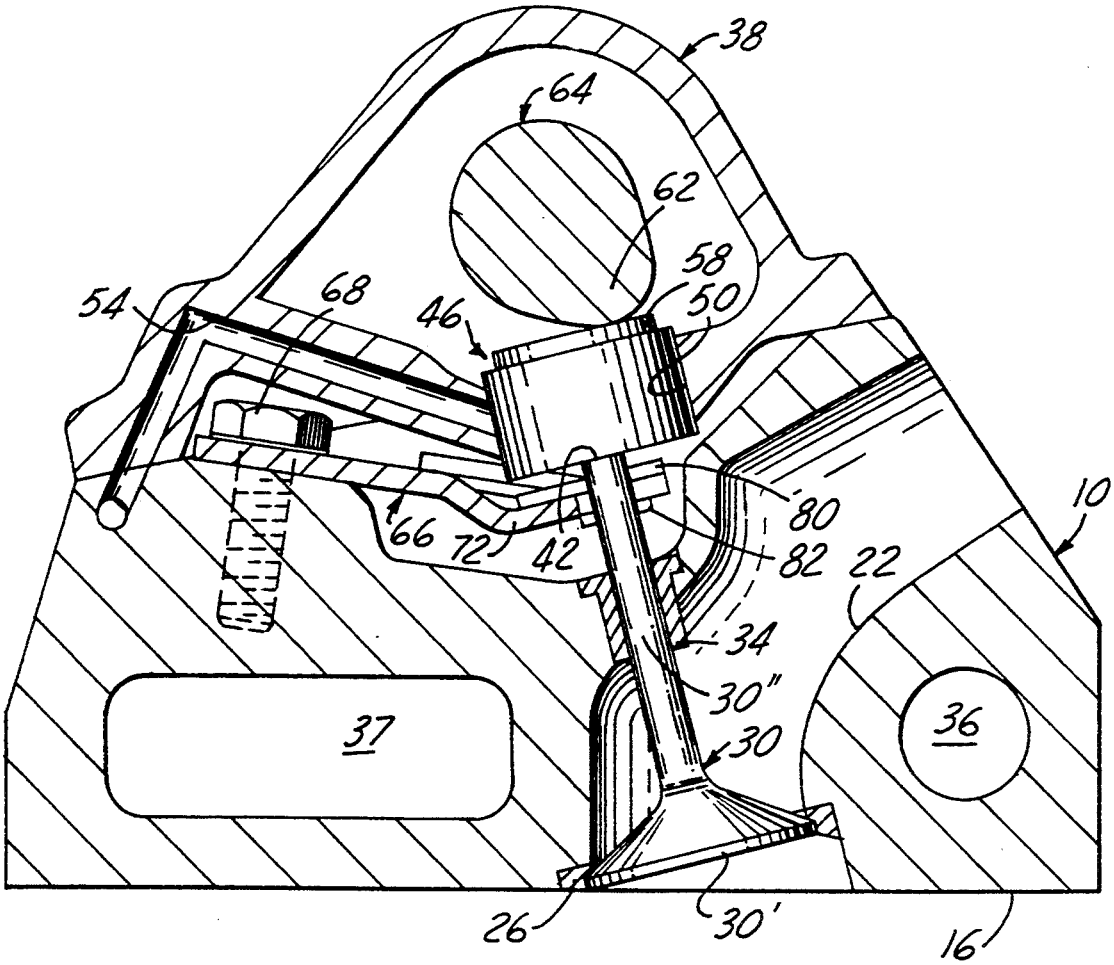
FIG. 3 is an elevational sectioned view of the cylinder head and leaf spring taken along section line 3—3 in FIG. 1 and looking in the direction of the arrows.

As seen in FIGS. 2 and 3, the cylinder head 10 has passages 36, 37 therein. Connected through surfaces 14, 16 are similar passages 36', 37' formed in the engine block 12. These passages are for passage of liquid coolant as is well known in the engine art.

The upper end of the cylinder head 10 has a valve cover member 38 attached thereto. The stems 28'', 30'' of valves 28, 30 define upper ends 40, 42 respectively. Inlet and exhaust valve lash adjusters 44, 46 are supported in bores 48, 50 and engage the ends 40, 42 of the valves. Typically, the lash adjusters 44, 46 are hydraulic devices which are supplied with pressurized oil through passages 52, 54 in the member 38 and the cylinder head, respectively. The upper surface 56, 58 of each lash adjusters 44, 46 is engaged by a cam lobe 60, 62 of a camshaft 64. Camshaft 64 extends axially normal to the plane of FIGS. 2, 3.

In a typical engine, the valves 28, 30 are held in their illustrated closed operative position by coil type springs. The subject cylinder head 10 utilizes a single leaf type spring 66 for yieldably urging both the inlet valve 28 and the exhaust valve 30 toward a closed position. The orientation of the spring 66 in relation to the cylinder bore 18 and valves 28, 30 is best shown in FIG. 1. An edge portion 68' of the spring is attached to a surface of the cylinder head 10 for support by a cap screw type fastener 68. The remainder of the spring 66 extends away from the supported edge portion as best seen in FIGS. 2 & 3. This unsupported or cantilevered portion is separated into an inlet valve spring portion or arm 70 and an exhaust valve spring portion or arm 72. A gap or channel 74 separates the two portions 70, 72 which permits either to flex independently of one another out of the unstressed plane of the spring 66.

The arm 70 has a notched end indicated at 76 to cause portions of the spring to partially encircle the stem 28'' of the inlet valve 28. Likewise, The arm 72 has a notched end indicated at 78 to cause portions of the spring to partially encircle the stem 30'' of the exhaust valve 30. It should be noted that the plane of the spring as shown in FIG. 2 is generally normal to the axis of the inlet valve 28. However, as seen in FIG. 3, this relationship does not exist. Accordingly, the arm portion 72 is bent at locations 72' so that the part adjacent to arm 72 is generally normal to the axis of the stem 30''.

The end portions of arms 70, 72 are operatively attached to the stems 28'', 30'' of valves 28, 30 by spring retainers 80, 82. One retainer 80 is located above the spring 66 and one retainer 82 is located below the spring 66. Both grasp the stem portion of the associated valve.

Although only a single embodiment of the subject valve spring arrangement for the cylinder head has been illustrated in the drawings and described in detail above, modifications will be readily apparent to one skilled in the art and the invention is to be described and defined by the following claims.

We claim:

1. In an internal combustion engine with a cylinder head of the type having an overhead camshaft for operating poppet type valves, means biasing a pair of adjacent valves toward their closed operative positions, comprising: a leaf type spring of relatively thin sheet configuration and having a generally flat edge portion; attachment means fixing said edge portion to the cylinder head, whereby the remainder of said leaf spring extends from the support portion of the cylinder head and is unsupported so as to be free to move out of the normal plane of said spring; means separating the unsupported portion of said spring into at least two individual arm portions to allow independent movement of either arm portion; both arm portions engaging an end of one of said adjacent valves; and means attaching the end of said arm to the valve so that the natural resiliency of the spring urges the valve into a closed operative position and yieldably allows its movement toward an open operative position.

2. The valve spring biasing arrangement set forth in claim 1 and a curved edge portion of the cylinder head adjacent the attachment of said spring so as to gradually increase the contact area of support for said spring and therefore decreasing the cantilevered portion as the valve is moved towards a more open operative position.

3. The valve spring biasing arrangement set forth in claim 1 in which the curvature of said edge portion is configured so as to effect the spring rate of said leaf spring as it moves against said curved edge portion during a valve opening phase of operation.

4. For an internal combustion engine with a cylinder head of the type having an overhead camshaft and a poppet type intake and exhaust valve with stem portions extending adjacent to one another, an improved leaf spring for biasing the pair of valves toward their closed operative positions, the improvement comprising: a leaf type spring of relatively thin sheet configuration relative to its width and length and defining a plane; the spring having a flat edge portion in said plane which is adapted to be attached to the cylinder head whereby the remainder of said leaf spring extends from this supported edge portion to form an unsupported and cantilevered portion which can flex relative to said plane; said cantilevered portion being separated into at least two individual arm portions separated by a cut-out portion whereby said individual arm portions are capable of independent movement out of said plane; said arm portions engaging a free end of one valve stem; and means attaching said free end to the valve stem so that the resiliency of the leaf spring, particularly in said arm portion urges the associated valve into a closed operative position and yieldably allows valve movement toward an open operative position.

5. The improved leaf spring set forth in claim 4 and a curved edge portion of the cylinder head adjacent the attachment to said spring so as to gradually increase the contact area of support for said spring and therefore decreasing the cantilevered portion as the valve is moved towards a more open operative position.

6. The improved leaf spring as set forth in claim 4 in which the curvature of said edge portion is configured so as to effect the spring rate of said leaf spring as it moves against said curved edge portion during a valve opening phase of operation.

* * * * *